US006557218B2

(12) United States Patent
Kipperman

(10) Patent No.: US 6,557,218 B2
(45) Date of Patent: May 6, 2003

(54) SNAP-TYPE BUCKLE

(75) Inventor: Eric Kipperman, Livingston, NJ (US)

(73) Assignee: Mississippi Trading, Inc., Miramar, FL (US)

( * ) Notice: Subject to any disclaimer, the term of this patent is extended or adjusted under 35 U.S.C. 154(b) by 0 days.

(21) Appl. No.: 09/900,240

(22) Filed: Jul. 7, 2001

(65) Prior Publication Data

US 2002/0013982 A1 Feb. 7, 2002

Related U.S. Application Data

(60) Provisional application No. 60/217,665, filed on Jul. 10, 2000.

(51) Int. Cl.[7] ..... A44B 11/25
(52) U.S. Cl. ..... 24/324; 2/322
(58) Field of Search ..... 24/324, 188, 194, 24/662, 701; 2/322

(56) References Cited

U.S. PATENT DOCUMENTS 1,849,807 A * 3/1932 Reiter ..... 24/324
1,923,050 A * 8/1933 Carr ..... 24/324
1,947,424 A * 2/1934 Reiter et al. ..... 24/324
1,956,031 A * 4/1934 Johnson ..... 24/324
2,061,466 A * 11/1936 Johnson ..... 24/324
3,538,554 A * 11/1970 Ford ..... 24/324
5,259,096 A * 11/1993 Grant ..... 24/324

* cited by examiner

*Primary Examiner*—Robert J. Sandy
(74) *Attorney, Agent, or Firm*—Pillsbury Winthrop LLP

(57) ABSTRACT

A snap-type buckle is disclosed including a buckle portion having a front surface and a rear surface and including an upper eyelet and a lower eyelet for receiving a strap, a recess extending through the rear surface, and a plurality of tabs located proximate the rear surface and extending radially inwardly. A button portion is configured for attachment to the strap and includes a step for engagement with the tabs of the recess. An embodiment of the snap-type buckle includes an aperture in the buckle portion to facilitate removal of the button portion from the buckle portion. Another embodiment of the snap-type buckle includes a spring arm extending across the recess proximate the front surface to facilitate removal of the button portion from the buckle portion.

4 Claims, 2 Drawing Sheets

SNAP-TYPE BUCKLE

CROSS-REFERENCE TO RELATED APPLICATION

This application claims the benefit of U.S. Provisional Patent Application No. 60/217,665, filed Jul. 10, 2000.

BACKGROUND OF THE INVENTION

1. Field of the Invention

The present invention relates to a snap-type buckle, and, more particularly, to a buckle used with a shoulder strap of a garment permitting a user to quickly detach the end of the shoulder strap from the buckle so that the strap can be quickly extended and the garment easily removed.

2. Background of the Related Art

Buckles including snaps for adjustably securing a loop of material to itself (such as a shoulder strap on a garmet) have been devised in a variety of configurations. A Snap Fastener Slide Socket, disclosed in U.S. Pat. No. 1,923,050 to Carr, is pressed from a single piece of metal and has a plate portion from which is pressed a tubular boss extending first upwardly from the plate portion and then curving outwardly passing through the plate portion so that one portion of the boss is locate at one side of the plate while the other portion is located at the opposite side. The boss is open at its free end and is turned inwardly upon itself at that end to provide a neck-engaging portion for snap fastening engagement with a stud. The boss is preferably divided by slits throughout its length into an equal number of portions which are adapted to expand and contract when engaged with or disengaged from the stud. A disadvantage of the Carr configuration is that it is a relatively complex, time consuming, and expensive article to manufacture (in comparison to the present invention.) Furthermore, because the Snap Fastener Slide Socket is made from sheet metal, it inherently has sharp edges on which a child can easily be cut or scratched. It is also difficult to remove the stud from the buckle portion without eventually tearing the stud from the loop of material.

A Strap Buckle is disclosed in U.S. Pat. No. 3,538,554 to Ford which is formed as a one-piece molding and includes a base formed with a stud-receiving aperture including a central opening of circular shape and radial communicating slots. The base extends between opposed sidewalls. To fasten the buckle the stud-receiving opening is presented to a nose of a stud and pressure is applied to force the buckle over the nose of the stud until an annular shoulder of the stud snaps over the edges of the circular portion of the stud-receiving opening. A disadvantage of the Ford configuration is that it requires a relatively complex mold to manufacture. Furthermore, the Strap Buckle requires a significant amount of pressure to engage the stud with the buckle because the user must not only engage the stud with the stud-receiving opening, but also force a portion of the loop of material between two upper arms of the buckle. This is particular problematic when the material is stiff, such as when it is canvas or heavy cotton. For this reason it is also difficult to remove the stud from the buckle without eventually tearing the stud from the loop of material.

In view of the above, there is a need for a snap-type buckle that solves the foregoing problems.

SUMMARY OF THE INVENTION

The subject invention, described herein below, eliminates the disadvantages exhibited in the prior art. In accordance with an embodiment of the subject invention, a snap-type buckle is disclosed including a buckle portion having a front surface and a rear surface and including an upper eyelet and a lower eyelet for receiving a strap, a recess extending through the rear surface, and a plurality of tabs located proximate the rear surface and extending radially inwardly. A button portion is configured for attachment to the strap and includes a step for engagement with the tabs of the recess. An embodiment of the snap-type buckle includes an aperture in the buckle portion to facilitate removal of the button portion from the buckle portion. Another embodiment of the snap-type buckle includes a spring arm extending across the recess proximate the front surface to facilitate removal of the button portion from the buckle portion.

These and other features of the subject invention will be made more readily apparent to those having ordinary skill in the art from the following detailed description of the invention taken in conjunction with the accompanying drawings.

BRIEF DESCRIPTION OF THE DRAWINGS

So that those of ordinary skill in the art to which the subject invention pertains will more readily understand how to make and use the snap-type buckle described herein, preferred embodiments of the invention are described with reference to the drawings, wherein.

DESCRIPTION OF THE PREFERRED EMBODIMENTS

Figure 1:
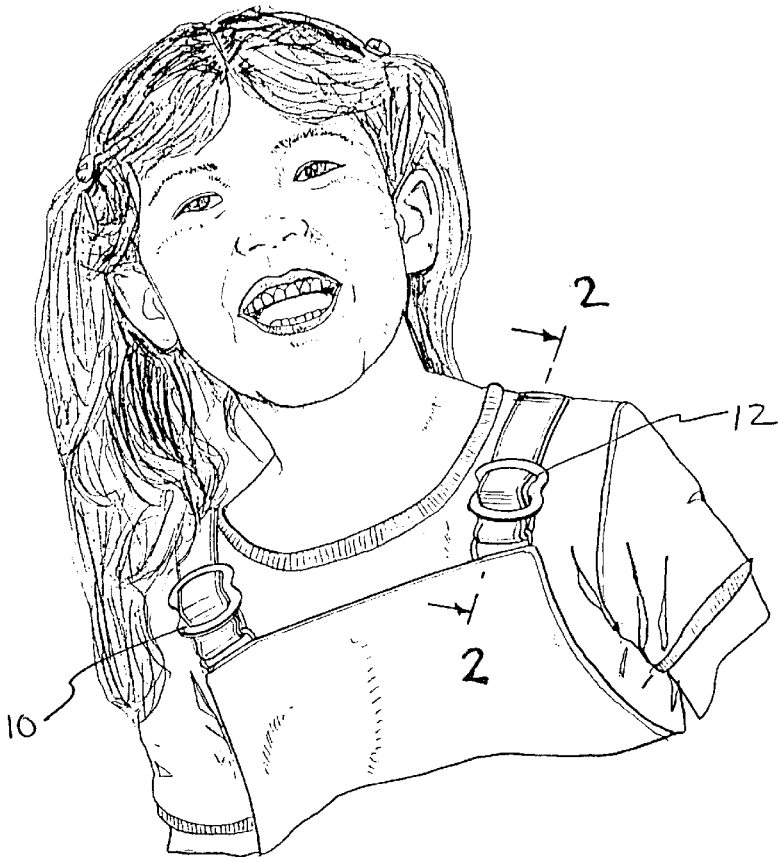
FIG. 1 is a view of a young girl wearing a garment to which two snap-type buckles are attached, one on each shoulder strap.

A snap-type buckle is disclosed for use on shoulder straps of a garment. Referring to FIG. 1, two snap-type buckles are shown attached to the shoulder straps of a young girls garment at 10 and 12. The garment may be a pair of overalls of the type including a bib in the front of the wearer and shoulder straps sewn to a rear panel of the overalls. The shoulder straps are intended to extended over the shoulders of the wearer and detachably attached to the front bib for securing the garment to the wearer.

Figure 2:
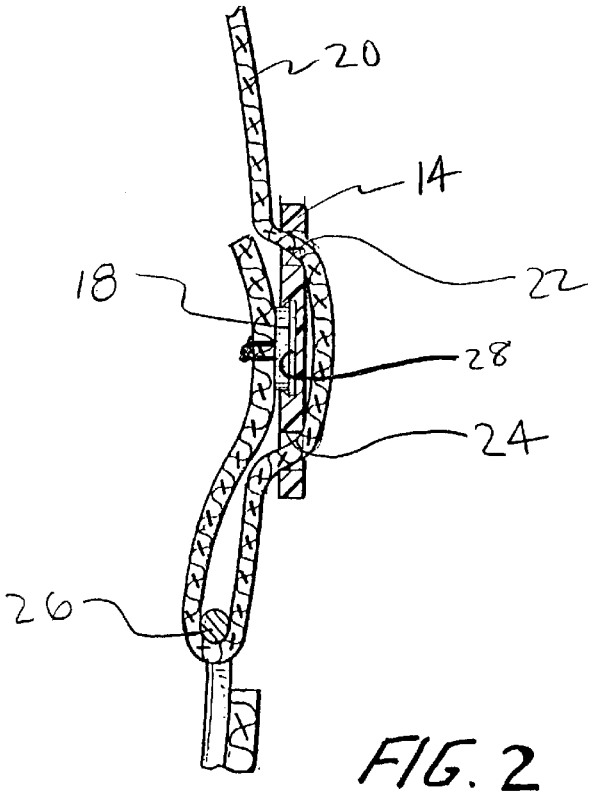
FIG. 2 illustrates a cross-sectional view of one of the snap-type buckles illustrated in FIG. 1.

Referring to FIG. 2, a cross section of snap-type buckle 12 reveals that the snap-type buckle includes a buckle portion 14 and a button portion 18. When assembled to a garment, the shoulder strap 20 is woven out though an upper eyelet 22 and into a lower eyelet 24 of the buckle portion 14, through a loop 26 attached to the garment, and back up to the buckle portion 14. The button portion 18 is attached, for example by sewing, near the end of the shoulder strap 20. The button portion 18 is snapped into a recess 28 in the rear of the buckle portion 14. The length of the shoulder strap is adjustable by slipping the shoulder strap through the upper and lower eyelets 22, 24 of the buckle portion 14.

Figure 3:
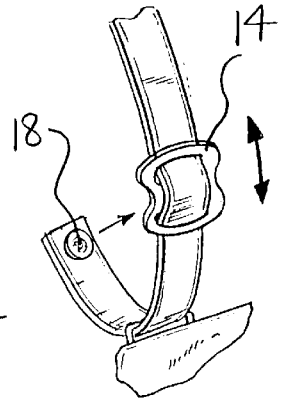
FIG. 3 illustrates a portion of a garment including a shoulder strap to which a snap-type buckle is attached, wherein the snap-type buckle has been unsnapped; thereby allowing the shoulder strap to be extended so the user of the garment may quickly and easily remove the garment.

Referring to FIG. 3, the button portion 18 is readily detachable from the recess 28 in the buckle portion 14. Detaching the button portion 18 from the buckle portion 14 allows the user of the garment to extend the shoulder strap, thereby permitting the user to easily remove the garment.

Figure 4:
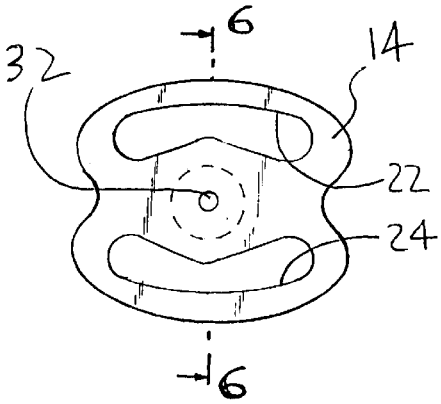
FIG. 4 is a front view of a buckle portion made in accordance with the present invention.
Figure 5:
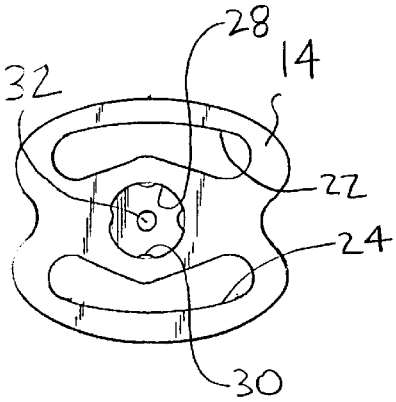
FIG. 5 is a rear view of the buckle portion illustrated in FIG. 4.
Figure 6:
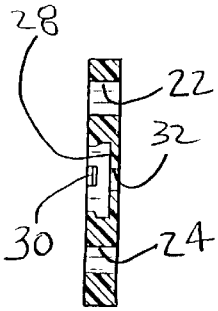
FIG. 6 is a cross-sectional view of the buckle portion illustrated in FIG. 4.

Referring to FIGS. 4–6, the buckle portion 14 is shown separated from a shoulder strap of a garment. The recess 28 of the buckle portion 14 includes tabs 30 for retaining the button portion 18. An aperture 32 may be provided to facilitate removal of the button portion 18 from the recess 28. A user may, for example, poke the tip of a pen through the aperture 32 to remove the button portion 18 from the recess 28 of the buckle portion 14.

Figure 7:
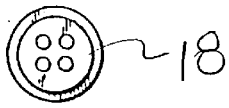
FIG. 7 is a front view of a button portion made in accordance with the present invention.
Figure 8:
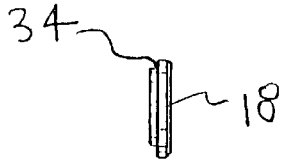
FIG. 8 is a side view of the button portion illustrated in FIG. 7.

Referring to FIGS. 7 and 8, a button portion 18 is illustrated. The button portion 18 includes a step 34 along one of its outer edges. The step 34 engages the tabs 30 when the button portion 18 is pressed into the recess 28 of the bracket portion 14.

Figure 9:
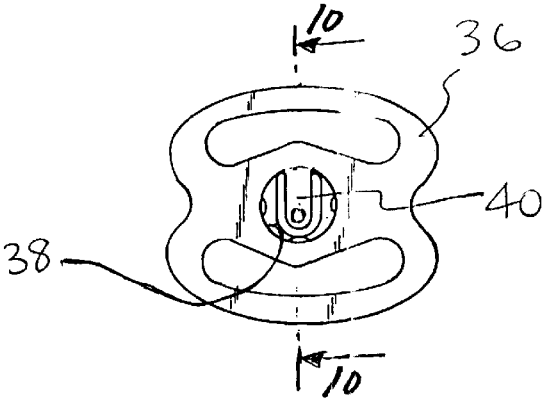
FIG. 9 is a rear view of a buckle portion made in accordance with the present invention.
Figure 10:
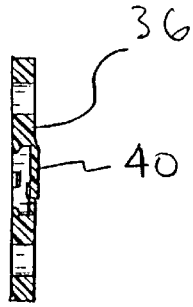
FIG. 10 is a cross-sectional view of the buckle portion illustrated in FIG. 9.

Referring to FIGS. 9 and 10, an alternate embodiment buckle portion 36 is shown. The buckle portion 36 also includes a recess 38. However, a spring arm 40 extends across the bottom of the recess 38. The spring arm 40 is provided to facilitate removal of the button portion 18 from the recess 38. A user may press on the spring arm 40 to remove the button portion 18 from the recess 38 of the buckle portion 36.

Although the snap-type buckle of the subject invention has been described with respect to certain preferred embodiments, it should be readily apparent to those skilled in the art that modifications and changes can be made thereto without departing from the spirit and scope of the invention as defined by the appended claims.

What is claimed is:

1. A snap-type buckle comprising:

a buckle portion having a front surface and a rear surface and including an upper eyelet and a lower eyelet for receiving a strap, a recess defined in part by a wall that extends through the rear surface and into the buckle portion, and a plurality of tabs that extend inward from the wall of the recess and are located proximate the rear surface; and a button portion configured for attachment to the strap and having a step for engagement with the tabs.

2. A snap-type buckle as recited in claim 1, wherein the buckle portion includes an aperture to facilitate removal of the button portion from the buckle portion.

3. A snap-type buckle as recited in claim 1, further including a spring arm extending across the recess proximate the front surface to facilitate removal of the button portion from the buckle portion.

4. A garment of the type including shoulder straps, each shoulder strap including a snap-type buckle comprising:

a buckle portion having a front surface and a rear surface and including an upper eyelet and a lower eyelet for receiving the strap, a recess defined in part by a wall that extends through the rear surface and into the buckle portion, and a plurality of tabs that extend inward from the wall of the recess and are located proximate the rear surface; and a button portion configured for attachment to the strap and having a step for engagement with the tabs.

* * * * *